US005947292A

United States Patent [19]

Chelfi

[11] Patent Number: 5,947,292

[45] Date of Patent: Sep. 7, 1999

[54] 'VENTILATED CASE FOR CARRYING AND EXHIBITING FRUIT AND VEGETABLE PRODUCTS

[76] Inventor: Domenico Giorgio Chelfi, Via V Alpini, 3, 23017 Morbegno (Sondrio), Italy

[21] Appl. No.: 09/046,492

[22] Filed: Mar. 23, 1998

[30] Foreign Application Priority Data

| | | | |
|---|---|---|---|
| Mar. 27, 1997 | [IT] | Italy | MI97A0734 |
| Mar. 27, 1997 | [IT] | Italy | MI97A0733 |
| Feb. 9, 1998 | [IT] | Italy | MI98A0242 |

[51] Int. Cl.[6] ..... B65D 5/32

[52] U.S. Cl. ..... 206/509; 229/109; 229/199; 229/120; 229/919

[58] Field of Search ..... 206/503, 509, 206/557, 561; 229/119, 120, 109, 164, 108, 199, 916, 919

[56] References Cited

U.S. PATENT DOCUMENTS

| | | | |
|---|---|---|---|
| 4,369,913 | 1/1983 | Muise | 229/120 |
| 4,372,476 | 2/1983 | Harned et al. | 229/120 |
| 4,645,122 | 2/1987 | Nederveld | 229/109 |
| 5,497,939 | 3/1996 | Hiskell et al. | 229/109 |
| 5,593,087 | 1/1997 | Ross et al. | 229/109 |
| 5,704,193 | 1/1998 | Roe et al. | 206/509 |

*Primary Examiner*—Paul T. Sewell
*Assistant Examiner*—Luan K. Bui
*Attorney, Agent, or Firm*—Hedman, Gibson & Costigan, P.C.

[57] ABSTRACT

The invention relates to a ventilated case, specifically designed for fruit and vegetable products, of the type made of corrugated cardboard or other like material, comprising a case body defining therein a holding space delimited by a bottom, two longitudinal sides and two transversal and opposite heads. The main feature of the invention is that each of the two heads is provided with at least two beveled or rounded corners, and that the longitudinal sides coupling the heads are provided with at least a perforated portion, slanted with respect to the vertical line or having a curved profile.

2 Claims, 7 Drawing Sheets

'VENTILATED CASE FOR CARRYING AND EXHIBITING FRUIT AND VEGETABLE PRODUCTS

BACKGROUND OF THE INVENTION

The present invention relates to a ventilated or aerated case, made of corrugated cardboard or other like material, specifically designed for carrying and exhibiting at a sell point a broad range of goods, and, in particular, fruit and vegetable products.

Prior corrugated cardboard cases, conventionally used for carrying and exhibiting fruit and vegetable products, have been made starting from a flat corrugated cardboard sheet element, which is so folded and glued to provide a case delimited by a pair of rectangular-shape transversal heads, opposite to one another and separated by two longitudinal sides, which are called "sidewalls". The central portion of the cardboard sheet element forms the bottom of the case.

The end portions of the cardboard sheet element, provided for forming the transversal or cross heads, are further folded in order to form substantially horizontal wings or flaps projecting to the side of the case and adapted to facilitate the stacking of a plurality of cases storing therein the desired products, for transportation and exhibiting purposes.

The above mentioned cases are broadly used in the fruit and vegetable product field, alternately to conventional wood cases, and are used as follows: they are filled with loose products, for example apples, pears, oranges, tomatoes, and so on, or they are filled by small baskets of plastic materials, in turn holding the products and forming a packaged selling unit, specifically designed for holding small-size products, such as apricots, plums, strawberries, and so on.

In the first type of application, the case is exhibited at the selling point, whereas in the second application, the case operates exclusively as an over-package for transportation purposes, whereas at the selling point are exhibited only the plastic material baskets, the case being disposed of.

A limitation of the above mentioned prior cases is that air is hindered from properly circulating therein, thereby the products are subjected to a quick spoiling.

Another problem is that of a poor visibility of the products held in said cases.

Moreover, in harsh use conditions, the above mentioned cases are subjected to mechanical failures at the head portions thereof, which head portions have a bearing function, with a consequent bulging of the product holding bottom.

SUMMARY OF THE INVENTION

Accordingly, a main object of the present invention is to provide such a fruit and vegetable product holding case allowing air to efficiently circulate therethrough, even with the case arranged at a desired exhibition place, thereby allowing the product to be better preserved.

A further object of the invention is to provide such a holding case having a comparatively high pressure strength, in particular in a stacked condition thereof.

A further object of the present invention is to achieve the above mentioned objects both under statical and under dynamical condition, in particular during the handling of the cases.

Yet another object of the present invention is to provide such a holding case affording a very good visibility of the product held therein and which, furthermore, is provided with very good aesthetical features thereby improving the attractiveness features of the products held therein.

According to one aspect of the present invention, the above mentioned objects are achieved by a ventilated case, specifically designed for carrying and exhibiting fruit and vegetable products, of the type made of corrugated cardboard or other like material, comprising a case body defining therein a holding space delimited by a bottom, two longitudinal sides and two transversal and opposite heads, characterized in that each of said heads is provided with at least two beveled or rounded corners, and that said longitudinal sides connecting said heads are provided with at least a perforated portion slanted with respect to a vertical line.

Moreover, the subject case construction further comprises reinforcement elements made of corrugated cardboard, pressed cardboard, wood or plastics material, glued or connected by any other suitable connecting means to the mentioned heads for stiffening said heads.

According to a preferred embodiment of the case according to the invention, each of said heads is provided with a polygonal configuration with more than four sides, and preferably an octagonal configuration, and to each of said heads a reinforcement element is applied, said reinforcement element including side portions folded as an obtuse angle to provide a bearing place for the horizontal flaps of the heads, thereby stiffening the package to allow it to better resist against dynamical stresses.

According to a further preferred embodiment of the present invention, specifically designed for comparatively low stresses, said reinforcement elements have a planar construction, without angled portions, and, in the case of very small loads, it is also possible to omit the mentioned reinforcement elements or inserts, thereby providing a case construction adapted to meet the requirements of a broad range of applications.

According to a further preferred embodiment of the present invention, the two heads are made of different cardboard portions, which are different from the bottom and sidewall portions.

The invention provides a lot of advantages with respect to the prior art.

At first, the inventive cases provide a good air circulation through the products, even if they are arranged on a selling bench. In fact, the beveled portions of the heads provide air circulation channels on the exhibiting bench, therethrough air can freely circulate even in the inside of the cases, owing to the specifically designed sidewalls thereof, and to the holes through the slanted portions thereof.

Moreover, the cases including head reinforcement elements will have a very high strength against possible vertical pressing forces, thereby preventing the heads from deforming and the products from being damaged, both under static and dynamical condition. Moreover, the double folding line on the bottom, due to the provision of the slanted portion, will provide said bottom with a greater stiffness, reducing to a minimum any bulging of the bottom.

This feature will allow to provide comparatively high strength packages, if required, while using, for the package main body, a corrugated cardboard material of small thickness and weight.

Thus, self supporting small packages (i.e. holding 1–2 kg of product) can be made, which, furthermore, can be easily stacked and will have good aesthetic properties. This will allow to use a recyclable material such as the mentioned corrugated cardboard even for the so-called "family use" packages (1–2 kg of product), thereby obviating any requirements to provide overpackagings for carrying purposes.

A further feature of the invention is that, owing to the beveled portions of the heads and the slanted portions of the sidewalls, increasing the visibility angle, the product held in the cases can be better seen.

Furthermore, the case construction is provided with very good aesthetical features, thereby correspondingly increasing the attractiveness of the products.

Yet another feature of the present invention is that the subject case can be made by assembling a given number of suitably contoured cardboard sheet elements, instead of using a single sheet. Thus, it is possible to provide a cardboard material of different strength, and use a stronger cardboard at those places of the case subjected to high stresses.

For example, the case can be made starting from three suitably shaped cardboard sheet elements. A portion of less strength can form the case bottom and sidewalls, whereas two portions of greater strength will form the case heads, which will be affixed by staples, glue or like systems to the case bottom. Thus, the strength/used cardboard material ratio can be increased.

A further feature of the present invention is that it provides the possibility of making a case starting from a contoured cardboard sheet element, by suitably folding it and coupling to one another the different portions thereof by fixed joint type of connections, without using glues or the like (a so-called self-assembling embodiment).

The inventive case, moreover, can also be made by using conventional case assembling and packaging apparatus.

BRIEF DESCRIPTION OF THE DRAWINGS

Further advantages and features of the present invention will become more apparent from the following detailed disclosure, given by way of an illustrative but not limitative example, with reference to the accompanying drawings, where.

DESCRIPTION OF THE PREFERRED EMBODIMENTS

In the following disclosure, some preferred embodiments of the invention will be disclosed by way of a not limitative example thereof.

The case 1 according to the present invention is made by performing simple folding and glueing operations starting from a single sheet element 50 including preset folding lines.

Figure 1:
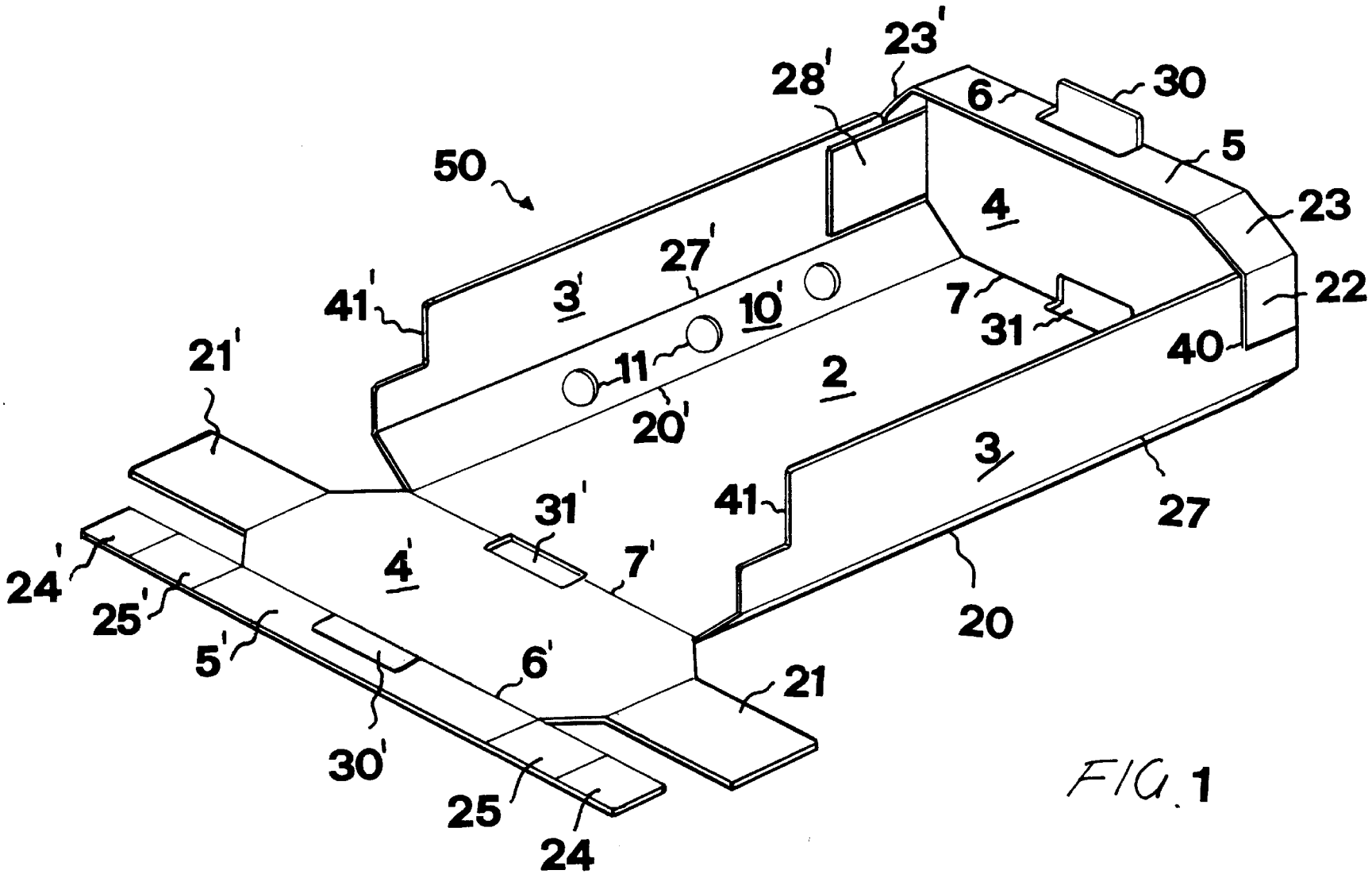
FIG. 1 illustrates a corrugated cardboard sheet element provided with set folding lines, and therefrom it is possible to form a case body according to the invention.

FIG. 1 illustrates the sheet element 50, provided of said preset folding lines, and substantially comprising a bottom 2, a first pair of longitudinal side portions 10, 10' which, in the assembled condition of the case 1 will be slanted with respect to a vertical line, and a second pair of longitudinal side portions 3, 3' which, in the assembled condition of the case 1, will be arranged substantially vertical and will form the sidewalls of the case 1.

The mentioned portions 10, 10' can be also alternatively made with a curved profile.

The slanted portions 10, 10' adjoins the longitudinal sides of the bottom 2 and are separated therefrom by suitable folding lines 20, 20'. The vertical portion 3 adjoins the slanted portion 10 and is separated therefrom by the folding line 27, whereas the slanted portion 3' adjoins the vertical portion 10' and is separated therefrom by the folding line 27'.

The vertical portions 3 and 3' are each provided with a pair of angle notches, respectively indicated by 40, 41 and 40', 41', which are formed by removing a suitable amount of material along suitable cutting lines, whereas the bottom 2 is provided with a pair of openings 31 and 31' each arranged on one of the transversal or cross sides of the bottom 2.

The rear, or polygonal portion 4, forming the head 60, is provided with a pair of flaps 28 and 28', whereas the rear 4' forming the head 60' opposite to the head 60 is provided with a pair or flaps 21 and 21'.

The rear 4 is separated from the bottom 2 by the folding line 7, and is further separated from the wing 5 by the folding line 6, whereas the rear 4' is separated from the bottom 2 by the folding line 7', and is separated from the wing 5' by the folding line 6'. Each of said wings 5 and 5' comprises tooth elements 30 and 30'. The wing 5 is moreover provided with rectangular portions 22, 23, 22' and 23', whereas the wing 5' is provided with rectangular portions 24, 25, 24' and 25'.

The slanted portions 10 and 10' are moreover provided with a plurality of holes 11.

Figure 2:
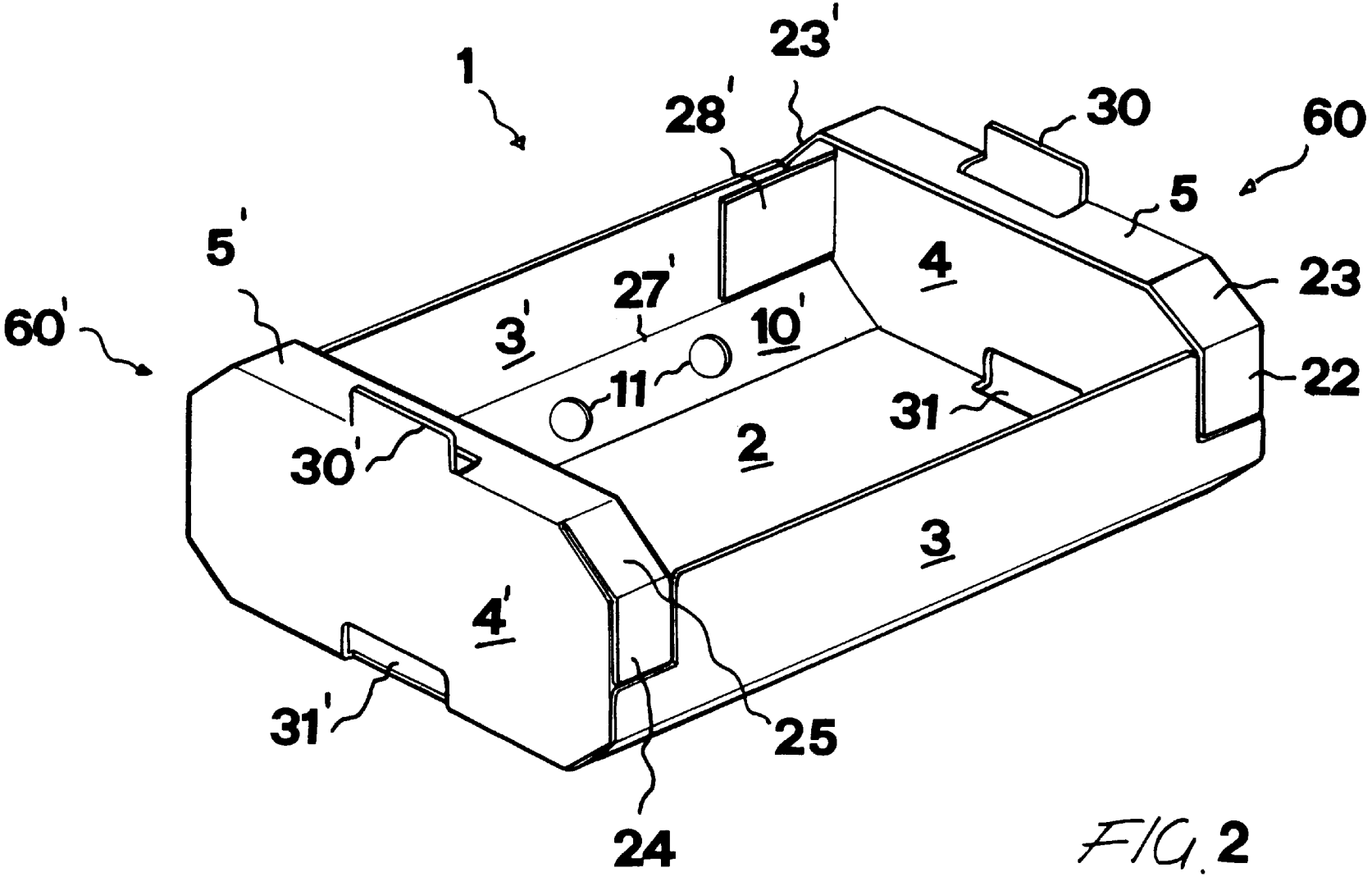
FIG. 2 is an axonometric view of the case shown in FIG. 1.

FIG. 2 illustrates a perspective view of a case 1 according to the invention. The case 1 is made by folding the sheet element 50 to form a bottom 2 and two longitudinal sides comprising the vertical portions 3 and 3', each of which is supported by the respective slanted portions 10 and 10'. The two heads 60 and 60' are formed by folding the rears 4 and 4' of the sheet element 50 respectively along the folding line 7 and 7', so as to bring the rears 4 and 4' to a substantially vertical position. The heads 60 and 60' are preferably clamped inside the case 1, by means of the flaps 21, 21' and 28, 28'. FIG. 2 clearly shows the connection of the head 60 inside the vertical portions 3 and 3', by the flaps 28 and 28'. The opposite head 60' is fixed or clamped inside the case 1 in a like manner.

The thus assembled case 1 is provided with two opposite heads 60 and 60' each of which includes the wings 5 and 5' at a substantially horizontal position parallel to the bottom 2 of the case 1.

The wings 5 is provided with wing portions 22, 22', 23 and 23' forming a part of the head contour.

More specifically, the portion 22 is fixed, outside of the case 1, on the flap 28, by means of the angled notch 40 formed in the vertical portion 3 by removing a given amount of material from said vertical portion 3.

Likewise, the portion 22' is fixed on the flap 28' by means of the angled notch or cut 40' provided in the vertical portion 3'.

These operations will provide the above mentioned head 60, whereas the head 60' is made in a fully analogous manner.

A section of the case 1, according to a plane parallel to the rears 4 and 4' and passing through the center of said case clearly shows the slanted attitude of the portions 10 and 10'. This slanted attitude is naturally analogous to that of the bottom angles of the heads 60, 60'.

Each head of the case 1 is provided with a tooth element 30, 30' and an opening 31, 31'. Said tooth elements 30 and 30' will allow a case 1 to hold a like case optimally positioned in an overlapping relationship therewith, by engaging the openings 31 and 31' thereof in the mentioned tooth elements 30 and 30'.

Figure 3:
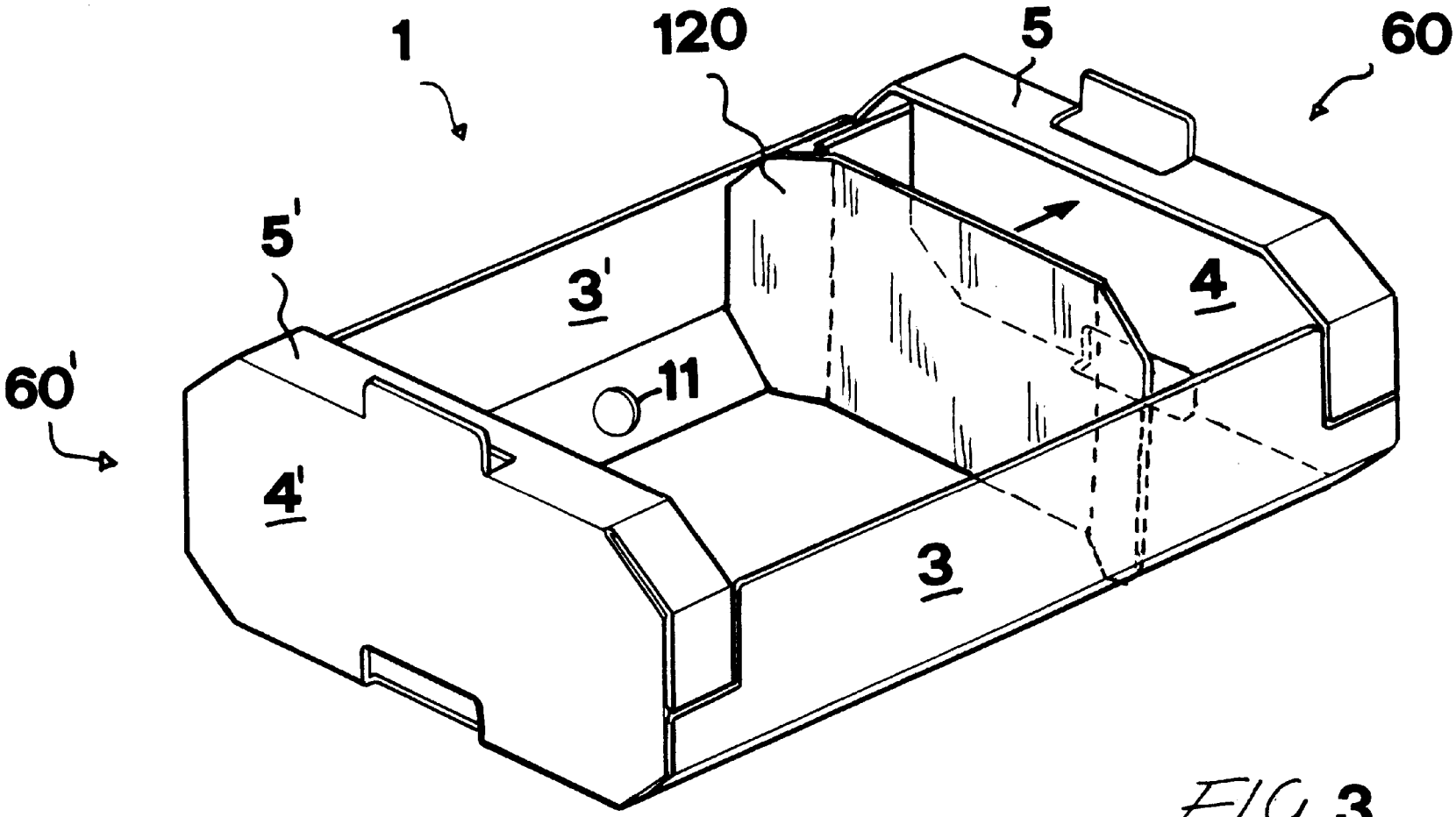
FIG. 3 is a further axonometric view of the case shown in FIGS. 1–2, in which are further included angular reinforcement elements.

FIG. 3 is an axonometric view of the case of FIGS. 1–2, at the head 60 of which is engaged the angular reinforcement insert 120.

A like reinforcement angular insert is engaged in the head 60'.

The above mentioned reinforcement inserts will provide the case with a high vertical pressure strength or resistance, even under dynamical conditions, thereby preventing the heads 60 and 60' from deforming and damaging the product held therein.

Figure 4:
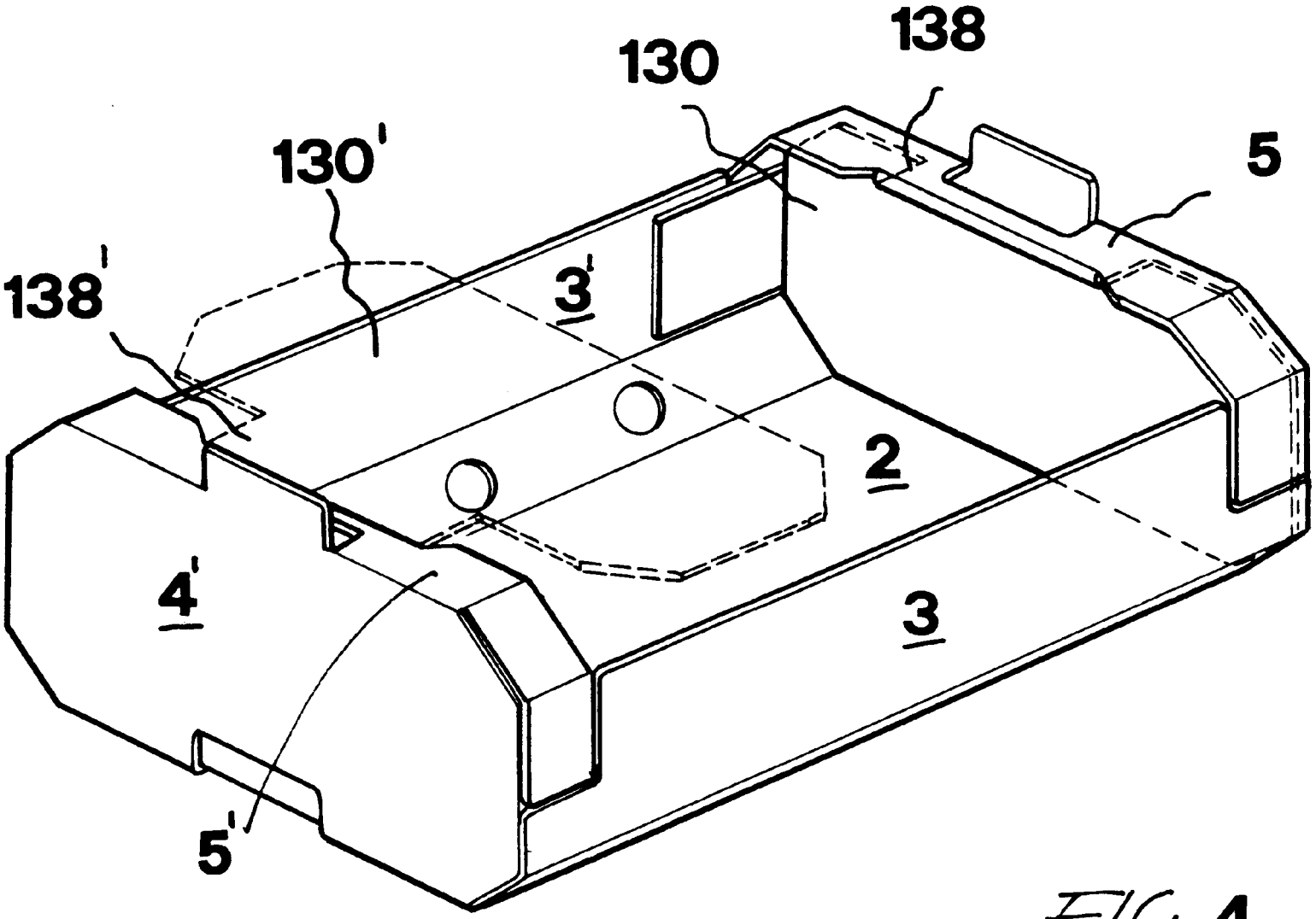
FIG. 4 is a further axonometric view of the case shown in FIGS. 1–2, provided with a second type of optional reinforcement element or inserts.

A second type of optional reinforcement elements 130 and 130' having analogous stiffening functions is shown in FIG. 4.

These reinforcement elements 130, 130' are respectively coupled to the wings 5 and 5' of the heads 60, 60' by the coupling portions 138, 138'.

A further type of reinforcement inserts comprises insert elements analogous to the inserts 120 and 120', and provided with obtuse-angle folded side portions, to which two flaps are added, said flaps being arranged outside of the folded side portions, to allow said reinforcement inserts to be glued to the vertical portions 3 and 3' defining the sidewalls of the case 1.

A further type of reinforcement inserts analogous to the inserts 120, 120' is provided with an angle-free planar construction, fitting the configuration of the case heads.

The sheet element 50 which, by the disclosed and glueing operations will form the case 1, is preferably made of corrugated cardboard either of the simple or double corrugation type, but, if desired, other materials can be also used, depending on requirements, such as a tensioned cardboard material, a plastic material, and so on.

Preferably, the heads 60 and 60' are coupled to the longitudinal sides of the case 1 by glue spots or other suitable coupling means.

A further embodiment of the present invention provides to form the case 1 starting from three suitably shaped cardboard material sheet elements.

A portion of less strength will be used for forming the case bottom and sidewalls, whereas two portions of larger strength will form the case heads which will be coupled by staples, glue spots or the like system to the bottom of the case.

Figure 5:
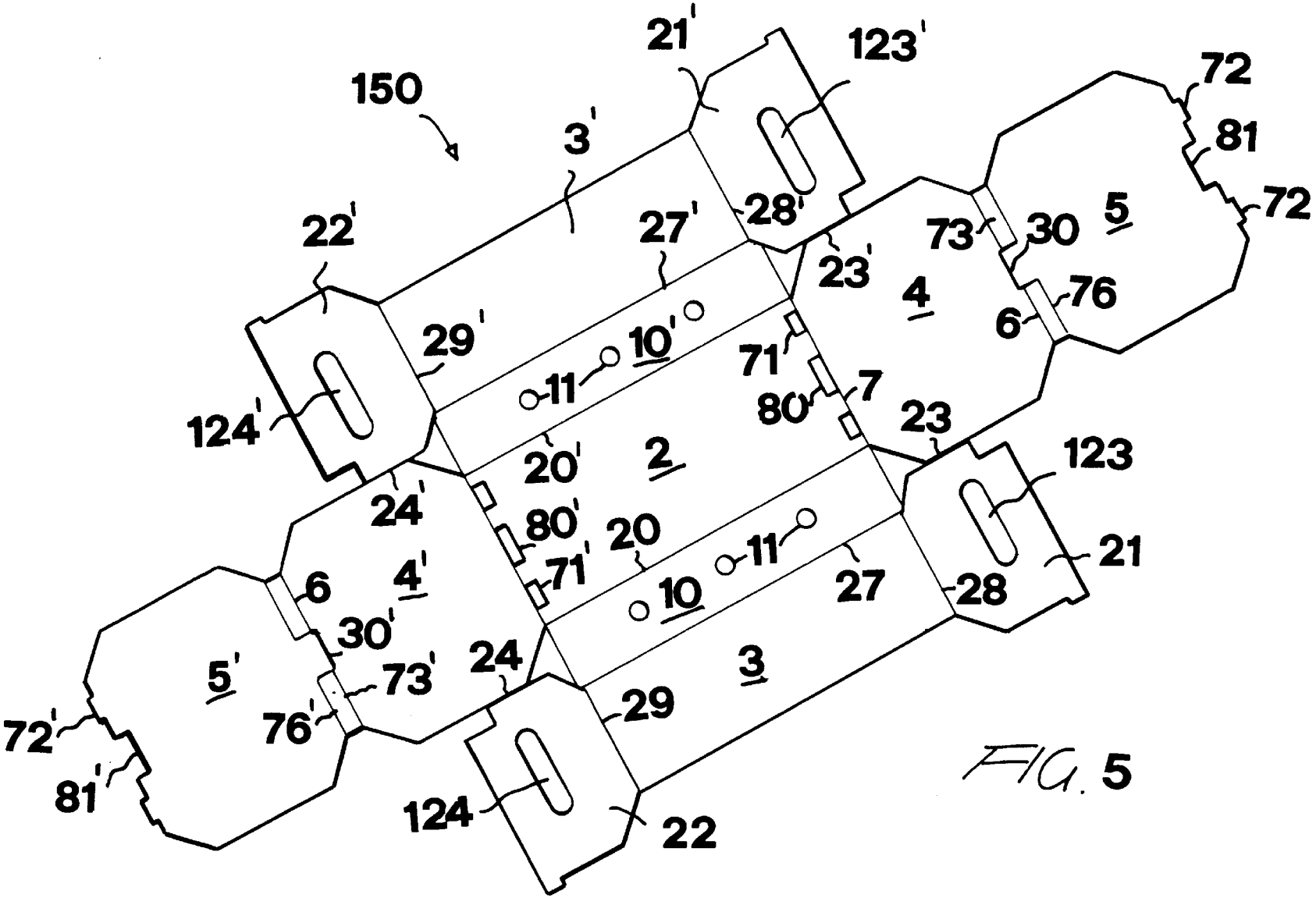
FIG. 5 is a top plan view illustrating a corrugated cardboard sheet element including preset folding lines, therefrom a case body according to the present invention (self-assembling embodiment thereof) is formed.

The case 100, according to a further embodiment of the present invention, will be formed by simple folding operations, starting from a sheet element 150, a top plan view of which is shown in FIG. 5 (in a self-assembling embodiment).

As stated, FIG. 5 is a top plan view of the sheet element 150, including preset folding lines, and comprising a bottom 2, a pair of perforated edges 10 and 10', and a pair of continuous edges 3, 3'.

Moreover, the sheet element 150 comprises a first pair of polygonal elements 4 and 5 separated by a strap or band element 73, and a second pair of polygonal elements 4' and 5', separated by a further strap or band element 73'.

The perforated edges 10, 10' adjoin the longitudinal sides of the bottom 2 and are separated therefrom by folding lines 20, 20'.

The continuous edge 3 is arranged adjoining the perforated edge 10 and is separated therefrom by the folding line 27, whereas the continuous edge 3' adjoins the perforated edge 10' and being separated therefrom by the folding line 27'.

The perforated edges 10 and 10' are each provided with a plurality of holes 11, whereas the bottom 2 is provided with a first and second pairs of openings 71 and 71'.

Each said pair is arranged on one of the transversal sides of the bottom 2.

Said bottom is moreover provided with a recess 80 and a recess 80'.

The continuous edge 3 comprises a pair of wings 21, 22, separated therefrom by folding lines 28 and 29, whereas the continuous edge 3' is provided with a pair of wings 21', 22' separated therefrom by folding lines 28' and 29'.

The wings 21 and 21' can be separated from the polygonal element 4 by cutting lines 23 and 23', whereas the wings 22 and 22' can be separated by the polygonal element 4' by cutting lines 24 and 24'.

Moreover, the wings 21, 21' comprise perforated portions 123, 123', whereas the wings 22, 22' comprise perforated portions 124, 124'.

The polygonal element 5 is provided with two tooth elements 72 and a recess 81, whereas the polygonal element 5' is provided with two tooth elements 72' and a recess 81'.

Figure 6:
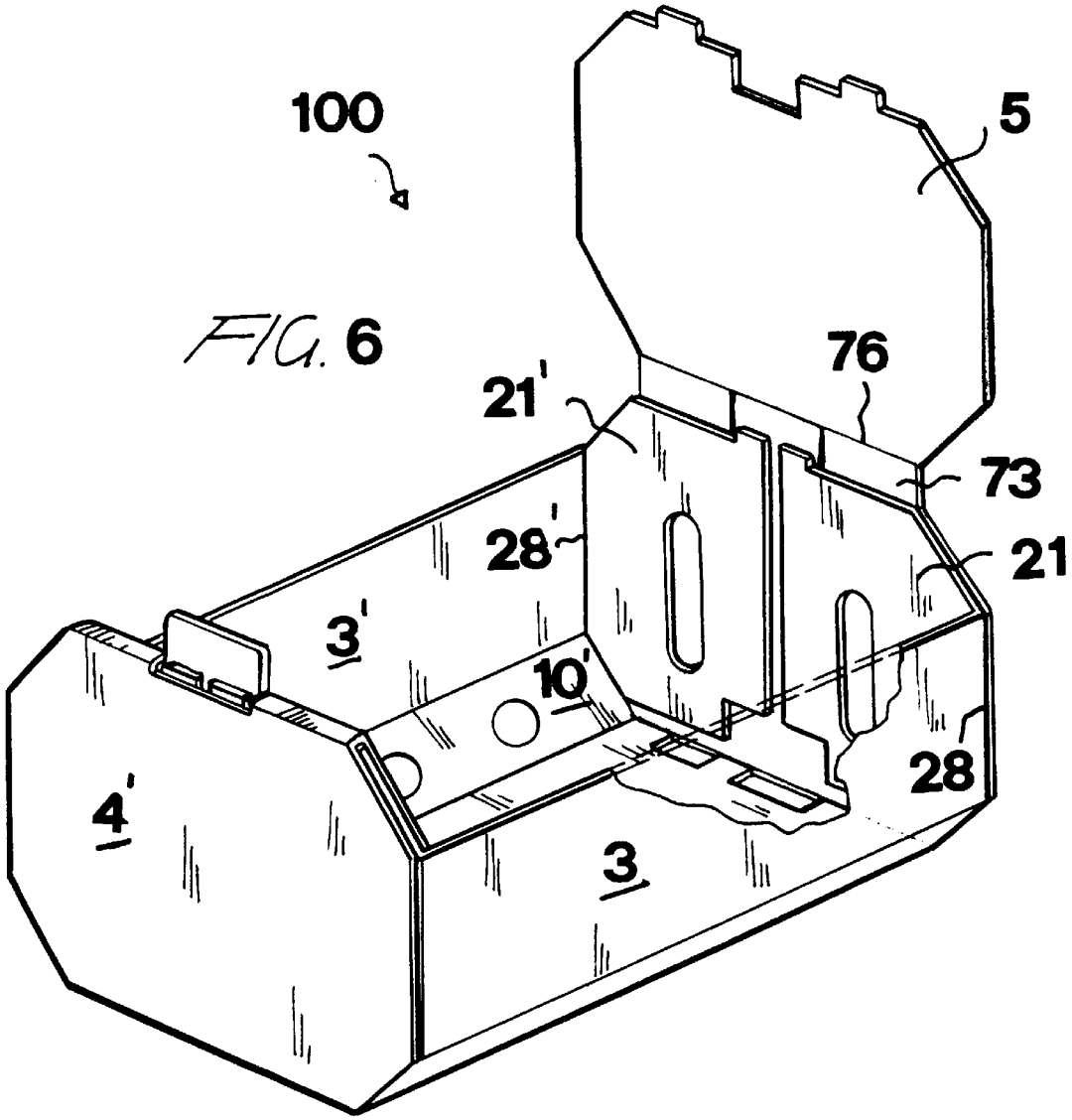
FIG. 6 is a further axonometric view of the case shown in FIG. 5, illustrating a method for closing by a fixed-joint closure the case.

FIG. 6 is an axonometric view illustrating the case 1 which can be made from the die-cut element of FIG. 1, in an intermediate assembling step.

More specifically, the case 100 is formed by folding the sheet element 150 to provide a bottom 2 and two longitudinal sides comprising the continuous edges 3 and 3', each whereof is supported by the respective perforated edge 10 and 10'.

Moreover, the wings 21 and 21' are folded by the folding lines 28 and 28' to be transversely arranged with respect to the edges 3 and 3', by forming vertical walls increasing the thickness of the head portion.

The second polygonal element 4' is folded along the folding line 7 to be arranged at a substantially vertical position, thereby forming the outer side of one of the head portion of the case 100.

The first polygonal element 5 is, on the other hand, folded along the folding lines 76 and 6, adjoining the band portion 73, to be arranged at a substantially vertical position for forming the inside side of the head portion.

Analogous folding operations are performed on the wings 22, 22' and polygonal elements 4' and 5' to form the mentioned separating wall elements and the opposite head, i.e. the head portion opposing to the above disclosed head portion.

Figure 7:
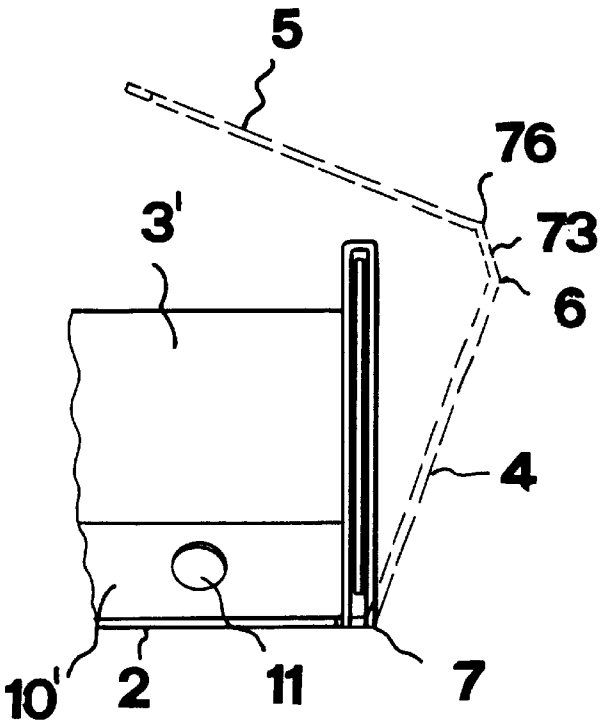
FIG. 7 illustrates a detail of a closure method for closing the case of FIG. 5.

FIG. 7 illustrates a detail of a closing method for closing the case 100, in which the dashed line shows the polygonal element 4 which can be folded with respect to the bottom 2 by the folding lines 7, and the polygonal element 5 which can be folded with respect to the polygonal element 4 by the folding line 76 and 6 and the band portion 73.

Figure 8:
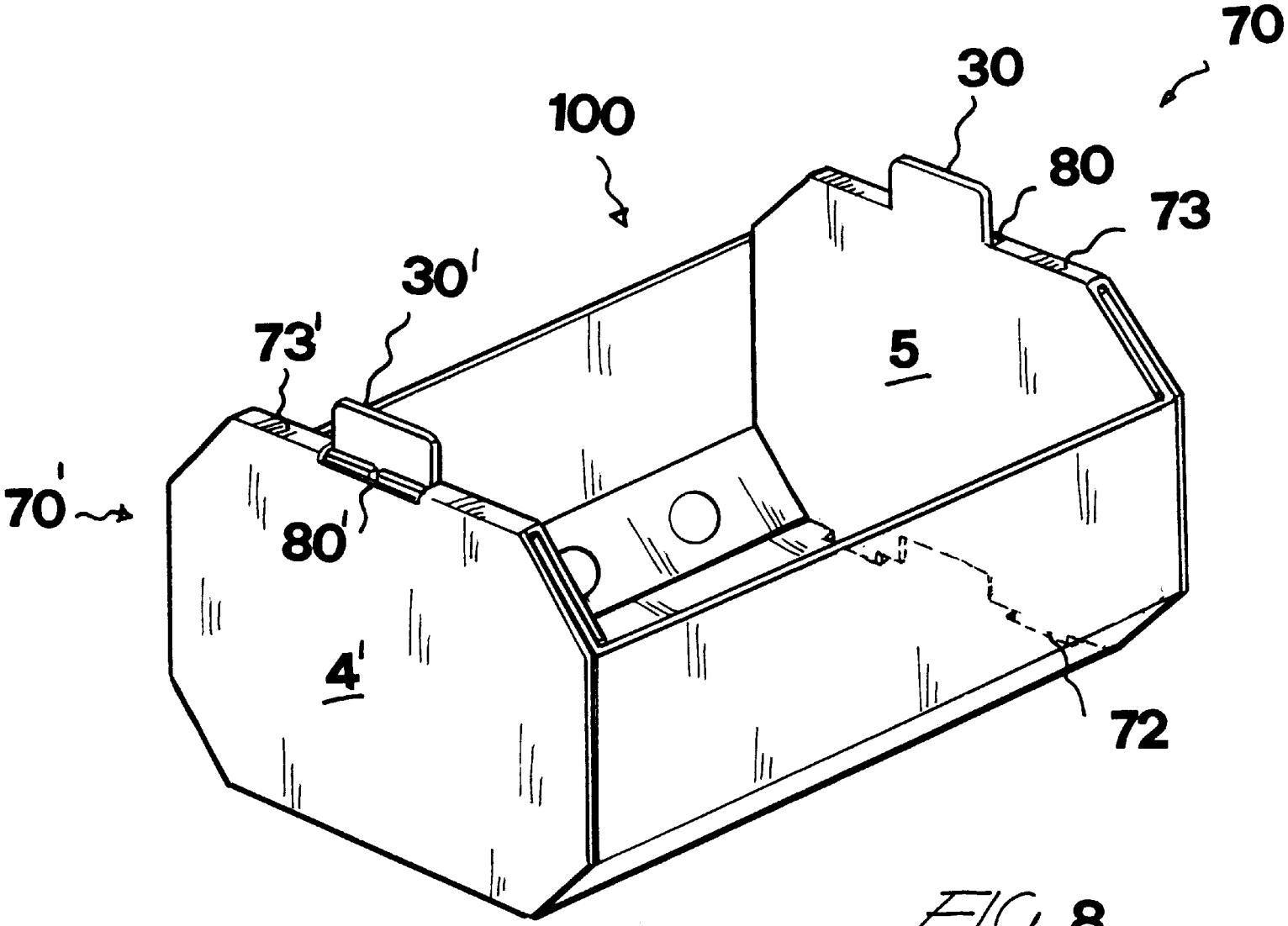
FIG. 8 is a further axonometric view of the case shown in FIG. 5.

FIG. 8 is an axonometric view illustrating the case 100, formed starting from the die-cut sheet element 150, by performing the disclosed operations. More specifically, FIG. 8 clearly shows the polygonal elements 4, 5 and 4', 5' forming the heads 70 and 70' of the case 100, as well as the band portions 73 and 73' forming substantially horizontal wings.

Moreover, the tooth elements 72 provided on the polygonal element 5 engage fixedly in corresponding openings 71 of the bottom 2 of the case 1 in order to hold in its set position the head portion 70 of the case 100.

Likewise, the small tooth elements 72' provided on the polygonal element 5' fixedly engage in corresponding openings 71' of the bottom 2 of the case 1 in order to properly hold in its set position the head 70'.

Thus, it should be apparent to one skilled in the art that the case 100 can be made and fixedly arranged in its operating position without using glue or adhesive materials, but by performing simple fixed engaging operations.

This property of the ventilated case 100 allows said case to be called of the "self-assembling" type.

Each of said band portions 73 and 73' is provided with a tooth element 30, 30' cooperating with corresponding openings 80 and 80' formed on the bottom of a like case in order to properly hold the latter in an overlapping position.

I claim:

1. An open top ventilated case for carrying and exhibiting fruit and vegetable products, said case comprising a case body defining therein a holding space comprised of a horizontal bottom, two longitudinal sides, vertical walls and two opposite transverse heads, each of said transverse heads having a first polygonal configuration including more than four sides, each of said transverse heads having at least two top beveled or rounded corners, each of said transverse heads being adapted to couple to said longitudinal sides, said longitudinal sides being provided with at least a slanted connecting portion connecting said vertical walls and said horizontal bottom of said case body, said slanted connecting portion being provided with a plurality of holes, each of said transverse heads being provided with a second polygonal portion which substantially fits an outer contour of said transverse heads, and is foldable with respect to said transverse heads, and includes a single tooth element for engaging a corresponding opening formed on a bottom of another like case when stacked on said another like case, said transverse heads having substantially horizontal wing elements, said ventilated case including cardboard reinforcing insert elements having a configuration substantially mating that of said transverse heads, said cardboard reinforcing elements being bound to said transverse heads, said reinforcing cardboard insert elements being provided with obtuse angle folded side portions which provide a bearing surface for said substantially horizontal wing elements on said transverse heads, said obtuse angle folded side portions having flap elements that allow a gluing thereof to said longitudinal sides of said case.

2. A ventilated case according to claim 1, wherein each of said transverse heads has an octagonal configuration, said case being made of corrugated cardboard, and said cardboard reinforcing insert elements being bound to said transverse heads by staples, glue, pressure or fixed type of joints.

* * * * *